US006341512B1

(12) United States Patent
Ramsauer

(10) Patent No.: US 6,341,512 B1
(45) Date of Patent: Jan. 29, 2002

(54) HORIZONTALLY OPERATED CLOSING DEVICE

(76) Inventor: Dieter Ramsauer, Am Neuhauskothen 20, D-42555 Velbert (DE)

( * ) Notice: Subject to any disclaimer, the term of this patent is extended or adjusted under 35 U.S.C. 154(b) by 0 days.

(21) Appl. No.: 09/486,672

(22) PCT Filed: Aug. 29, 1997

(86) PCT No.: PCT/EP97/04723

§ 371 Date: Jun. 5, 2000

§ 102(e) Date: Jun. 5, 2000

(87) PCT Pub. No.: WO99/11893

PCT Pub. Date: Mar. 11, 1999

(51) Int. Cl.[7] ..... E05B 13/10

(52) U.S. Cl. ..... 70/208; 70/207; 292/336.3; 292/DIG. 31

(58) Field of Search ..... 70/208, 209, 207, 70/211, 370, 371, 451, 483, 484, 489, 467; 292/39, 142, 150, 336.3, DIG. 31

(56) References Cited

U.S. PATENT DOCUMENTS 2,750,217 A * 6/1956 Landholt ..... 292/DIG. 31
3,745,796 A * 7/1973 Fleming ..... 70/208
4,132,092 A * 1/1979 Steinbach ..... 70/208
4,134,281 A * 1/1979 Pelcin ..... 70/208
4,631,937 A * 12/1986 Debus et al. ..... 70/208

FOREIGN PATENT DOCUMENTS

| | | |
|---|---|---|
| EP | 0 261 266 | 3/1988 |
| WO | WO 94/15049 | 7/1994 |

* cited by examiner

*Primary Examiner*—Richard M. Camby
(74) *Attorney, Agent, or Firm*—Reed Smith LLP

(57) ABSTRACT

A closing device for doors of cases or cabinets preferably constructed out of thin wall material such as sheet metal and especially to the operation of catching systems, such as closing bars, which are mountable in the canted area of sheet metal cabinet doors. The closing device is comprised of a door plate having two door plate areas, whereby a first longitudinally extended door plate area has a turning handle for operating and a drift pinion which is rotationally mounted. The second door plate area has a push plate which is mounted in a slidable manner. The push plate interacts with the drift pinion and the catching system via a catch. The catch reaches through one of the slots in the door covered by the second door plate area. The second door plate area is also longitudinally extended, connected to the first longitudinally extended door plate area as one piece, and shaped in such a way that the extending axis of the second longitudinally extending door plate area is vertical to the extending axis of the first longitudinally extending door plate area.

16 Claims, 11 Drawing Sheets

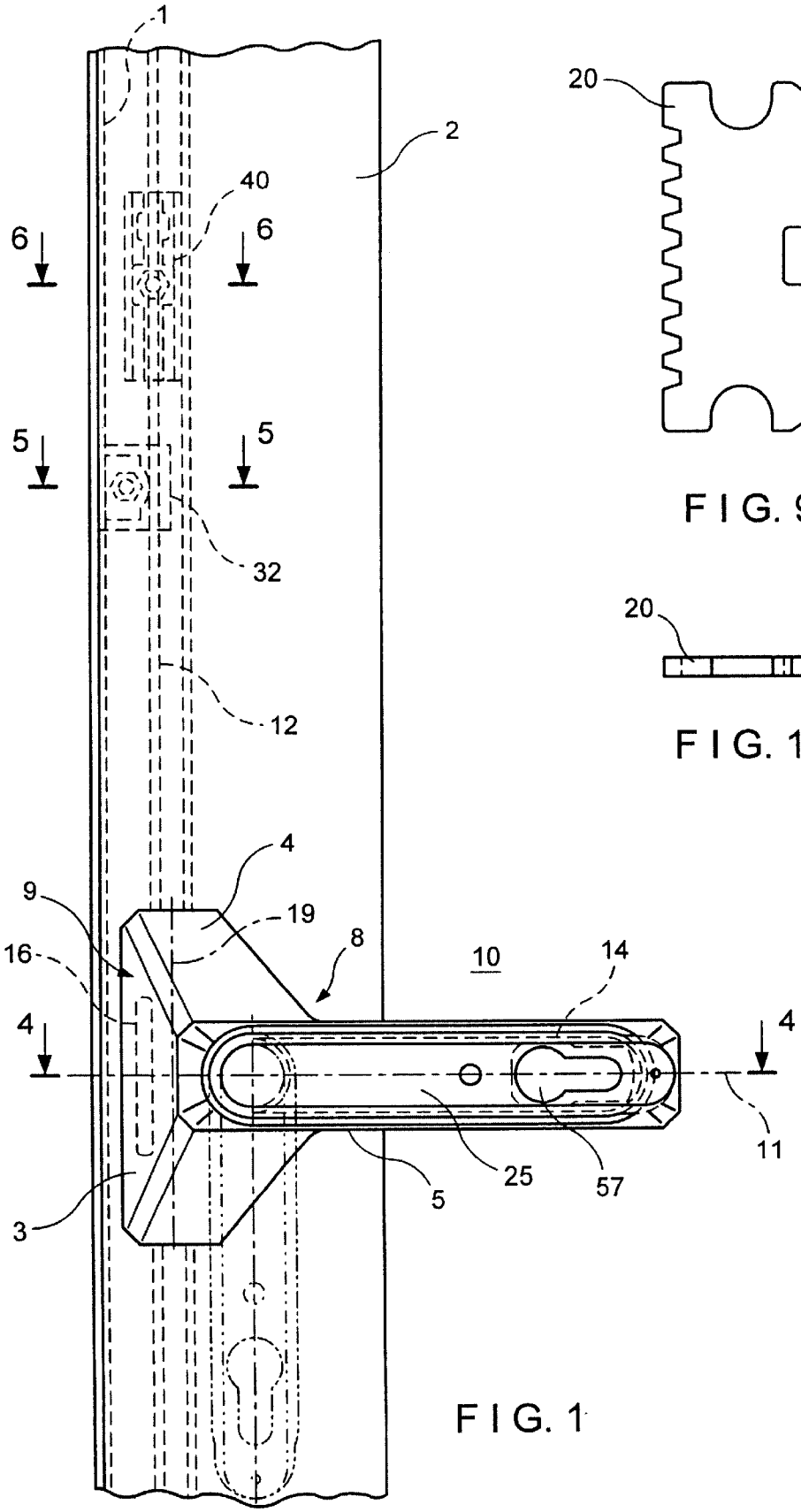
FIG. 1
FIG. 9
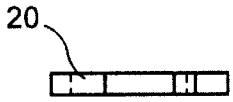
FIG. 10

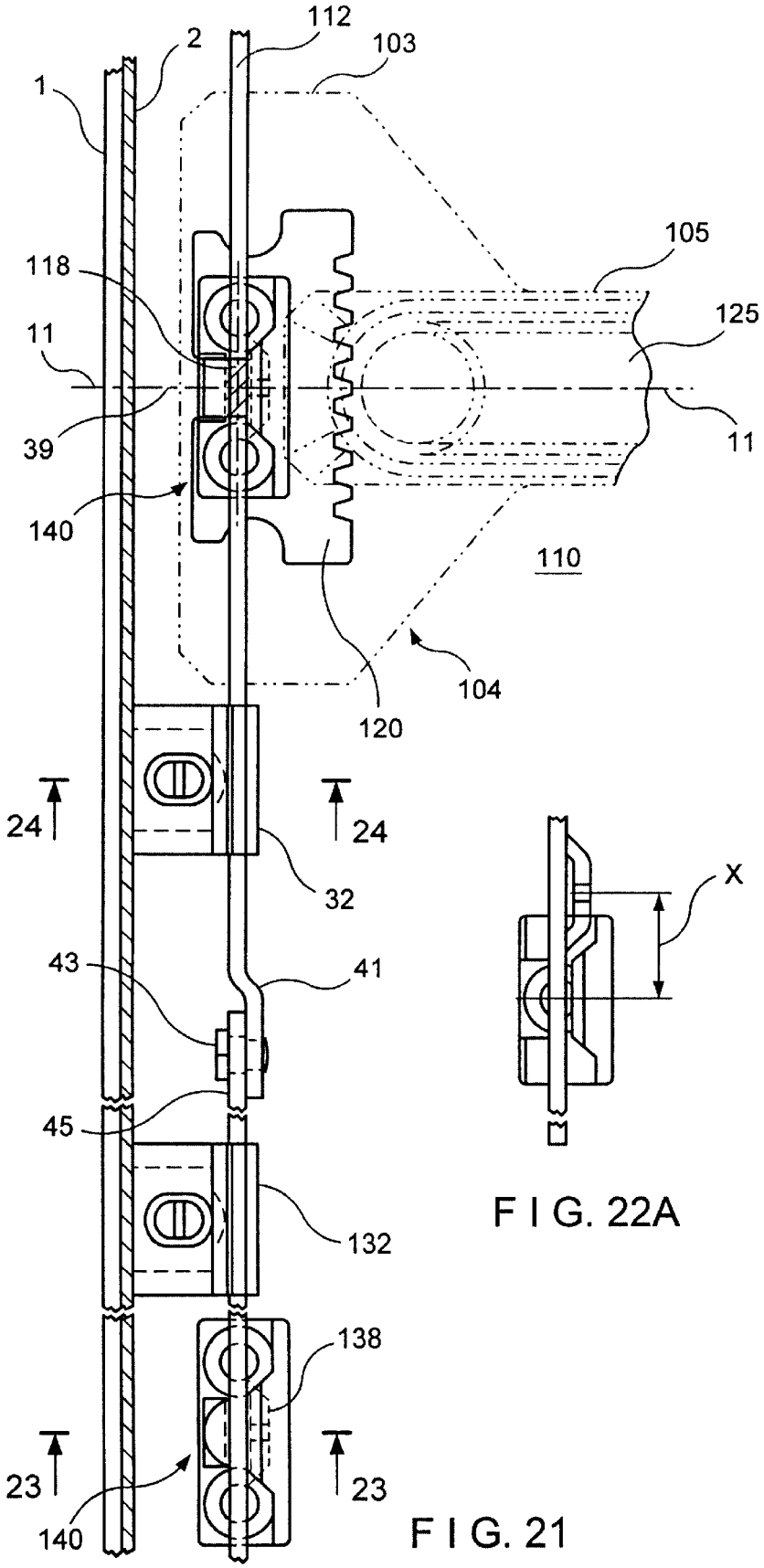
FIG. 21
FIG. 22A
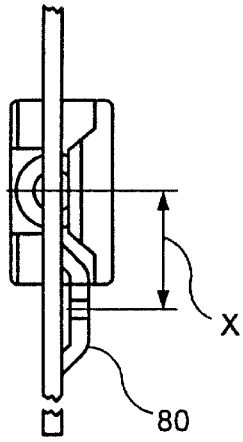
FIG. 22B

HORIZONTALLY OPERATED CLOSING DEVICE

BACKGROUND OF THE INVENTION

1. Field of the Invention

The invention is directed to a closing device for doors of housings or cabinets, preferably made from thin wall material such as sheet steel, especially for the actuation of locking systems, such as locking bars, which can be introduced in the canted or fold space in sheet-metal cabinet doors, this closing device comprising a door plate with two door plate regions, wherein a first, elongated door plate region has a handle, such as a swivel lever, and supports a spindle pinion so as to be rotatable, and wherein the second door plate region supports a push plate so as to be displaceable, which push plate is in an operative connection with the spindle pinion and which is, in turn, in an operative connection with the locking system via a shoulder which extends through a slot in the door that is concealed by the second door plate region.

2. Description of the Related Art

A swivel lever closing device of this type is already known from WO 94/15049 which is based, in turn, on EP 0 261 266 B1.

The closing device is provided especially for switch cabinets, but also for cabinets or housings which are used in work places for electronics and other technical fields to house electronic devices or components.

Cabinets or housings of the type mentioned above usually have construction dimensions of 19 inches, but can also be manufactured in metric sizes. The use of especially narrow counter-stops has proven advisable in order to provide a usable interior space which is as large as possible and easily accessible. For example, a narrow hollow section serves as a mounting frame to which side walls or back walls and doors are attached. Alternatively, switch cabinets formed from bent sheet metal can also be provided, these switch cabinets having a canted or folded region in which locking devices, e.g., bar locks such as those known from the above-mentioned European patent are advisably accommodated. In this swivel lever closing device known from EP 0 261 266 B1, a base plate comprising the door plate is arranged with one protuberance in a first rectangular opening in the door leaf provided in the region of the swivel lever articulation, while a second protuberance is provided for receiving a cylinder lock supported in the free end of the swivel lever. The two openings are arranged so as to be axially symmetric with respect to the longitudinal axis and it is therefore possible to mount the closure in these two rectangular openings of identical dimensions in such a way as to enable conversion from right to left. The swivel lever closing device according to this European patent can be used in a particularly advantageous manner with flat bar locks, which also enables accommodation in narrow profile spaces such as in the canted space in sheet-metal cabinet doors, for example. The door plate is fastened by means of projections on the base plate of the door plate which can be inserted into the rectangular openings of the door leaf or which engage behind the openings or by means of a cap part or retaining part which is screwed on from the inside of the door. The swivel lever closing device according to the above-cited reference requires little space and is suitable for doors fastened on the left-hand side as well as for doors fastened on the right-hand side.

However, the closing device known from this reference also has disadvantages. The lock itself is arranged eccentrically, which is disadvantageous. That is, a subsequent change of the fastening or door folding entails removal of the locking bar, of which there is at least one, or disassembly of the lock. Moreover, the locking bar which is guided in the region of the base plate can negatively affect the construction design of the closing device, especially in the region of the cylinder lock. Further, when rows of cabinets are used, the door plate can undesirably limit the opening angle of the door of an adjacent cabinet.

According to WO 94/15049, the second protuberance is not arranged in the region of the swiveling axis of the swivel lever, but rather is arranged so as to be offset by 180° relative to the actuating axis of the swivel lever. This makes it possible to swivel the swivel lever optionally into one of two positions in the base plate which are offset by 180° with respect to rotation and to secure it in the desired position by means of the cylinder lock accommodated in the swivel lever. Certain advantages are achieved by means of this design and are described in WO 94/15049 on pages 3 and 4. In other respects, however, the disadvantages mentioned above also apply in this case.

OBJECT AND SUMMARY OF THE INVENTION

It is the primary object of the present invention to further develop the swivel lever closure known from WO 94/15049, namely, in such a way that it is constructed not only in a simpler and more compact manner and can therefore be manufactured more inexpensively while retaining the advantages of the known closing device, but also enables a larger opening angle for the door of an adjacent cabinet when used in a cabinet row arrangement.

This object is met in that the second door plate region is likewise elongated and is shaped and connected in one piece with the first elongated door plate region in such a way that the axis of extension of the second elongated door plate region extends at right angles to the axis of extension of the first elongated door plate region. This step results not only in a symmetry with respect to the center of the door leaf and, accordingly, in simplified construction and mounting, but also offers the possibility, in particular, of reducing the constructional height in the neighborhood of the edge of the door, which leads to larger door opening angles for the adjacent cabinet when used in a row of cabinets.

The closing device according to the invention can be actuated by means of a socket wrench or can have a swivel lever, in particular a swivel lever which can lock in a recess formed by the door plate.

It is particularly advantageous when the push plate which can be actuated, e.g., via the swivel lever and the spindle pinion is in an operative connection with a locking bar (arranged parallel to the longitudinal extension of the push plate) and a driver or protuberance connected with the locking bar is provided in the area of the door plate.

It is advantageous when the spindle pinion is connected with the push plate via meshing teeth of the latter and this push plate is connected with the locking bar via the driver or protuberance and when the spindle pinion and the push plate are received by the door plate virtually in a positive engagement.

According to a further development, the driver is adjustable at the inner side of the door and in the area of the shoulder plate and is connected with the locking bar via connection areas, wherein the driver is guided by a protuberance in a recess of the push plate which extends at right angles to the driver plane.

On one or both sides of the locking bar, rollers or projections forming locks with the locking bar can be provided in the area of receptacles on the cabinet side, wherein receptacles which are constructed in a complementary manner and have vertical stop faces and in which the rollers or projections engage may be provided. In a construction of this kind, it is advantageous when the receptacles which are preferably fastened in the fold area of a cabinet frame or housing frame are constructed as hooks or double-hooks with an opening for the locking bar, which opening is directed toward the door.

The push plate can have a first opening oriented to its center axis for receiving the protuberance and two additional recesses at a distance X along the longitudinal axis relative to this recess, wherein the distance X is that distance traveled by the push plate when the swivel lever is rotated by 90°.

In the same way, the protuberance can be formed by a molded piece which is formed from a protuberance area and a driver area, wherein the protuberance area is arranged at one end of the driver area and the driver area has a longitudinal extension corresponding approximately to the length of the protuberance width plus the distance X.

The driver area can have, in the longitudinal axis oriented to the axis of the locking bar, three bore holes through which are guided fastening screws which can be received in a threaded bore hole formed by the locking bar, wherein the axial distance between the bore holes makes up a fraction of the distance X, equals the distance X, or is a multiple of the distance X.

BRIEF DESCRIPTION OF THE DRAWINGS

The invention is described more fully in the following with reference to embodiment examples shown in the drawings:

FIG. 1 is a (reduced-scale) top view showing a closing device constructed according to the invention in combination with a sheet-metal cabinet door;

FIG. 9 shows a top view of the push plate of the closing device shown in FIG. 1;

FIG. 10 shows a side view of the push plate according to FIG. 9;

FIG. 21 shows a rear view of another embodiment form of the closing device according to the invention in combination with a sheet-metal cabinet door with modified receptacles for differently configured locking bars, in this case, in the locking position;

FIGS. 22A and 22B shows associated views of open positions of the locking bar;

DESCRIPTION OF THE PREFERRED EMBODIMENTS

Figure 2:
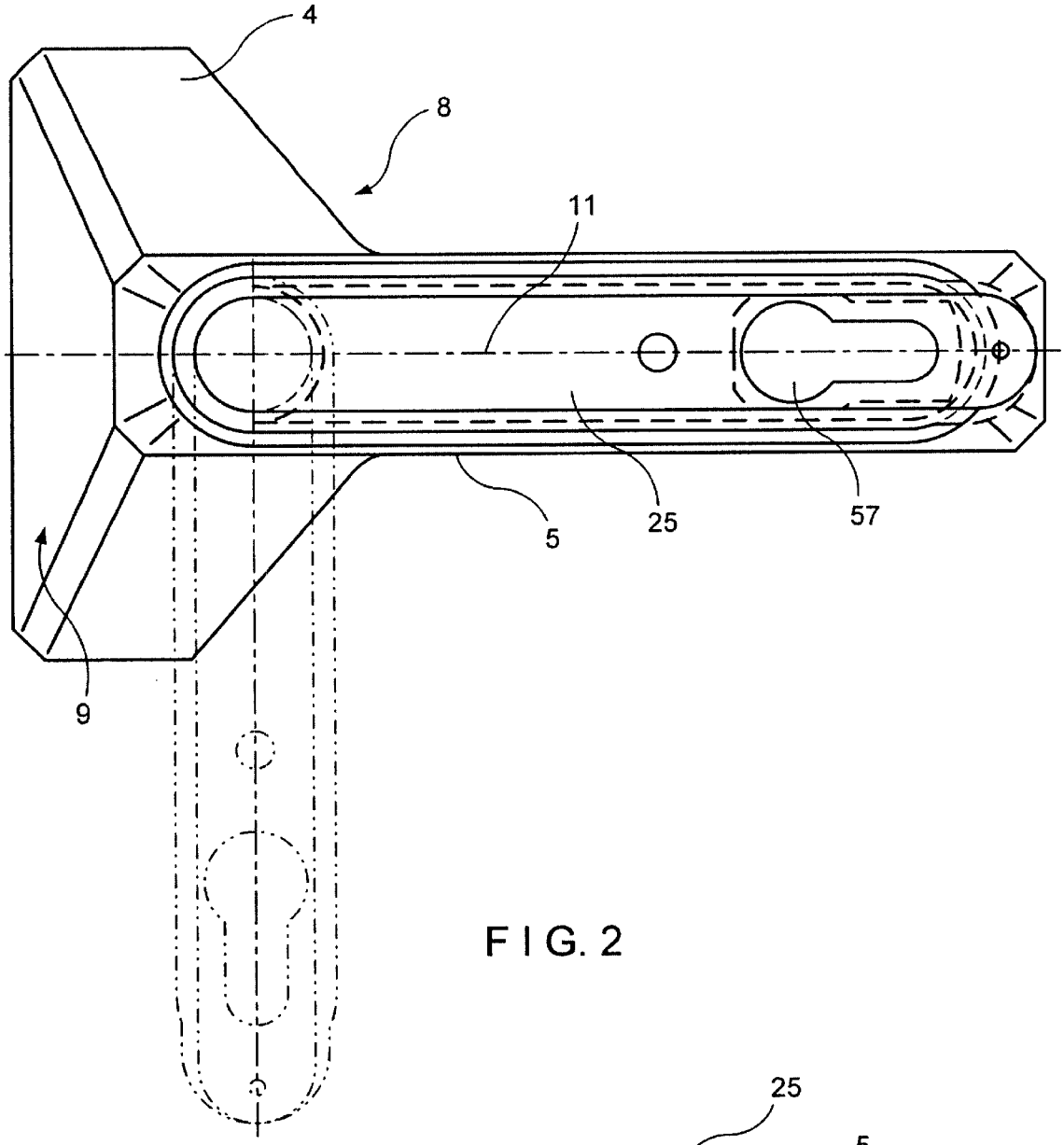
FIG. 2 shows the closing device shown in FIG. 1 in a partial view approximately to scale.
Figure 3:
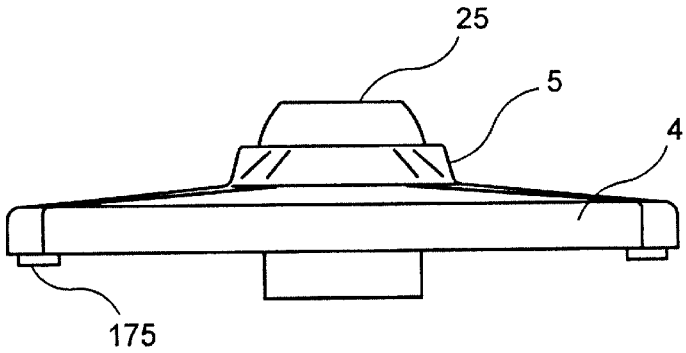
FIG. 3 shows a view from the left-hand side of the arrangement according to FIG. 2.
Figure 4:
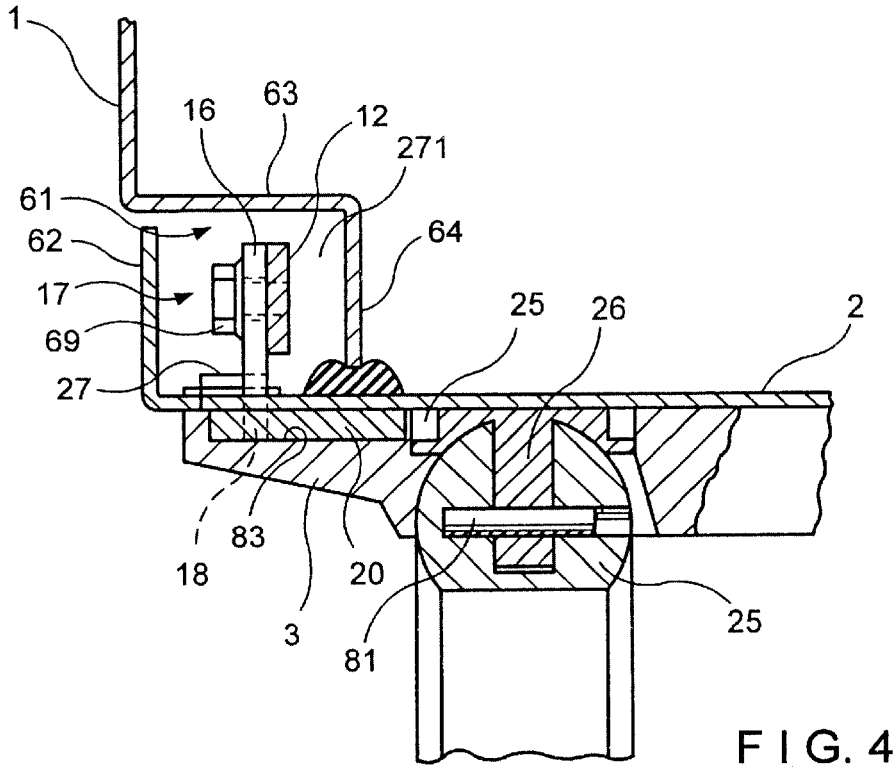
FIG. 4 shows a cross-sectional view of the closing device along line IV—IV in FIG. 1.
Figure 23:
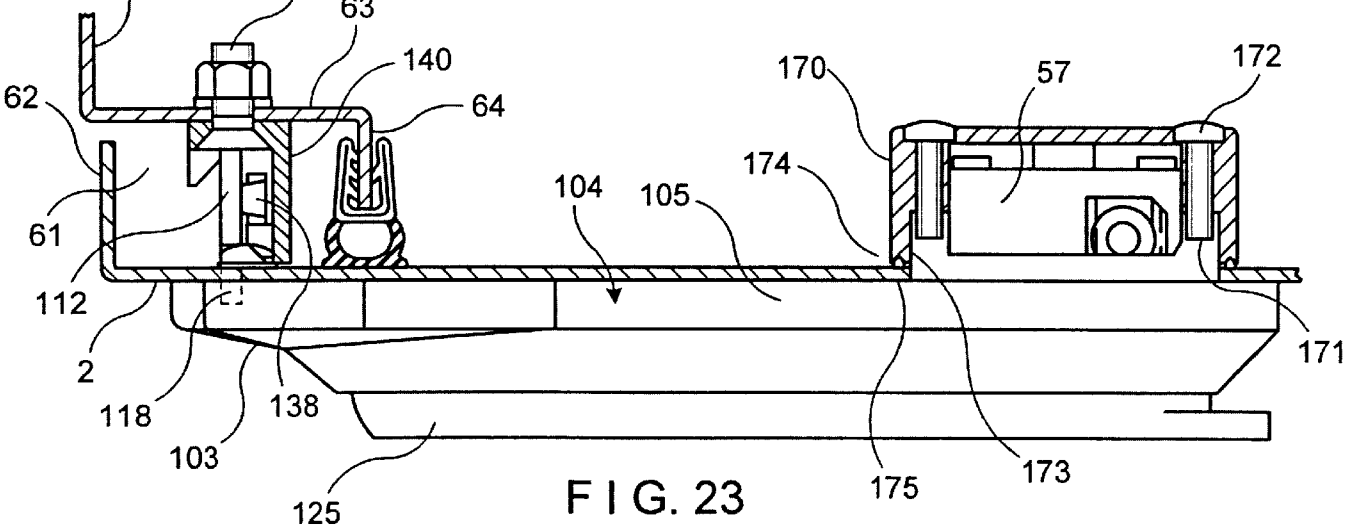
FIG. 23 shows a view along line XXIII—XXIII of FIG. 21.

FIG. 1 shows a top view and FIG. 21 shows a rear view of a closure according to the invention, shown herein as a swivel lever closure 10 and 110, respectively, which is arranged at a sheet-metal cabinet door 2 which is, in turn, fitted in a suitable manner inside a frame 1 of a switch cabinet, sheet-metal housing or the like, see also FIG. 4 and FIG. 23. The swivel lever closure device comprises a door plate 4, 104 which is arranged on the outer surface of the door leaf 2. The door plate 4 has a first door plate region 8 or base plate 5, 105 and a second door plate region 3 connected therewith.

A swivel lever 25, 125 is arranged as a handle in the region of the base plate 5, 105 and can be secured in the swiveled-in position in the closing position shown in solid lines via a key-operated locking arrangement, e.g., cylinder lock 57. The locking arrangement need not be accommodated in the swivel lever 25, 125 as in the embodiment example shown in the drawing, but rather may also be arranged inside the door plate or base plate and can hold the swivel lever 225 in its swiveled-in position in a suitable manner, see FIGS. 27 and 28.

In order to convert a left-handed door such as that shown by way of example in FIGS. 4 and 23 into a right-handed door in a simple manner, the entire arrangement, as is shown in FIG. 1 and FIG. 21, is constructed so as to be axially symmetric with respect to a line 11 bisecting the door leaf 2. The corresponding hole pattern in the door leaf is likewise axisymmetrical around this axis 11 and comprises, for example, a rectangular opening which is arranged symmetrically with respect to line 11. In order to carry out the conversion mentioned above, the door leaf need only be rotated by 180° so that the portion of the door plate which was formerly at the top, e.g., in FIG. 1, is now located on the bottom and the portion (door plate region 3) formerly on the left side is now on the right side. As a result of the symmetrical arrangement, the swivel lever 25 can be locked again in the same horizontal position, so that it is possible to switch the closing side of the door leaf from the right side to the left side, and vice versa, without changing the closing devices.

Figure 8:
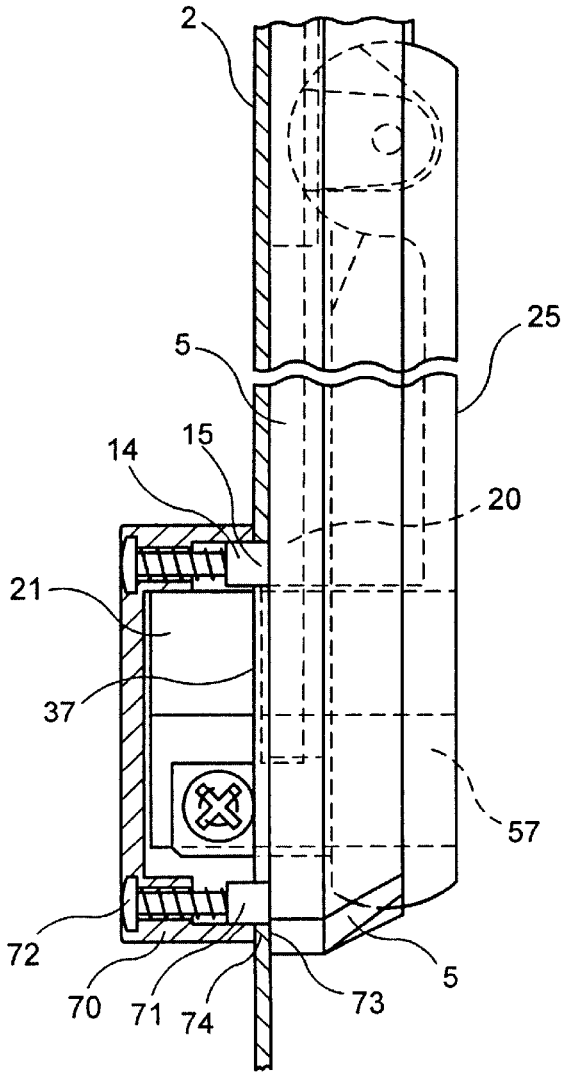
FIG. 8 shows a side view of another part of the closing device shown in FIG. 1.

The mounting of the base plate 5 is carried out in accordance with FIG. 8 by means of a cover or covering cap 70, 170 which is fitted to the back face of the door leaf 2 and which secures the base plate 5,105 mounted on the front face of the door leaf 2. As in EP 0 261 266 B1, the locking bar devices 12, 112 which use up space are advisably accommodated in the fold space 61 which, as can be seen, e.g., in FIG. 4, is formed on one side by the fold 62 of the door leaf 2 and on the other side by the fold 63, 64 of the door frame 1 or the like. The locking bars which are constructed in this instance as upended flat bars 12 can also be conveniently guided within this fold space 61, for example, by means of the bar guide 32, 132, shown in FIG. 5 and FIG. 24, which is also present in the prior art.

Figure 6:
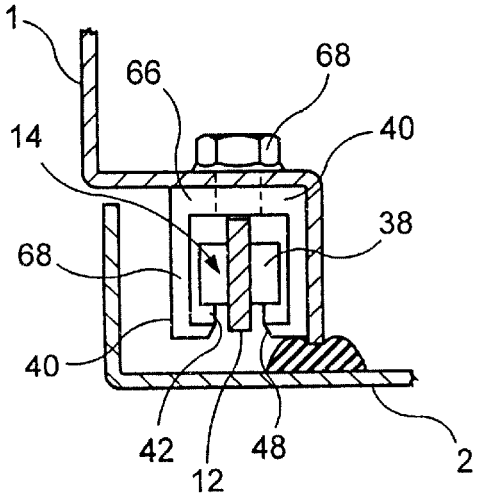
FIG. 6 shows a cross-sectional view along line VI—VI in FIG. 1.
Figure 20:
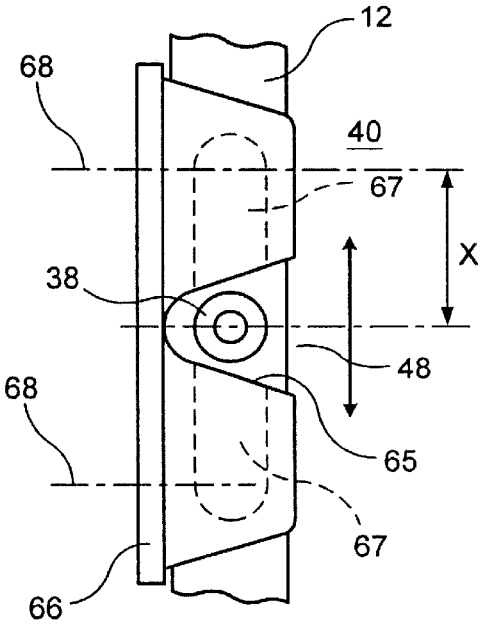
FIG. 20 shows a side view of the closing area of FIG. 1.

Correspondingly, in accordance with FIGS. 6 and 20 or 21 and, e.g., 25, 26, closure elements can also be accommodated within this space 61. On the one hand, the closure elements comprise a receptacle 40, 140 which is secured to the door frame 1 and, on the other hand, comprise roller pins 38 or locking projections 138 which are supported on the locking bar 12, 112 and which can move into this receptacle portion provided on the door leaf 1.

For smooth operation of the arrangement, it is advisable, according to FIGS. 1, 6 and 20, that the receptacle, e.g., a hook-shaped run-in element for the double roller pins 38, be provided in twofold, namely, such that, e.g., the double roller pins 38 can, in a determined position of the locking bar 12, move into a conically widening slot 65 formed by the two open ends of two hooks 67 which are mounted on a common base 66 or project from the latter so as to be integral therewith. This base 66 is then fastened to the door frame 1 by cap screws which are shown in FIG. 6 (e.g., see reference number 68). The hook-shaped configuration 67 can be open or can have side walls 68 to increase stability and prevent bending under heavy loads. FIGS. 23 to 26 show another construction having locking projections 135 which are stamped out, punched out or pressed out of the locking bar 112 toward one side of the bar and are symmetrically disposed in the area of the profile center of the locking bar 112 and which run into symmetrically constructed hooks which are fastened to the cabinet by means of two screw bolts according to FIGS. 25A, B and C and by means of only one screw bolt according to FIG. 26.

The position of the pin 38 shown in FIG. 20 is the open position, e.g., a position in which the swivel lever lies in the vertical line (swiveled down or swiveled up). In contrast, the pin or projection 138 is in the locking position in FIG. 22, wherein the locking projection 138 has run into the hook region 140. In this position, the swivel lever is located in a horizontal (or, as the case may be, swiveled-in) position. As a result of this mechanical symmetry, the ratios are completely identical regardless of whether the doors are constructed so as to close to the right or, after rotating by 180°, to the left.

According to FIG. 1 which shows a schematic overall view of the closing device 10 according to the invention, a bar-shaped driver 16 is provided in the area of the region 3 of the door plate 4, see also FIG. 4. This driver 16 is in an operative connection, via a protuberance 18, with a push plate 20, also shown in a top view and a side view in FIG. 9 and FIG. 10, and can be adjusted in the vertical direction with this push plate 20. A locking bar 12 extends above and below the door plate 4 parallel to the driver 16 and is connected therewith in a connection region 17, e.g., by means of a screw bolt 69 which projects through one of three bore holes 270 shown in FIG. 7, and is then screwed into a threaded bore hole 271 in the locking bar 12. As will be seen from the drawings, the locking bar 12 and the driver 16 are arranged at right angles to the inner side of the door 2 and also relative to the plane of extension of the door plate region 3.

In the embodiment form according to FIG. 22, on the other hand, a protuberance 118 proceeds from the bar 112 integral therewith.

Alternatively, a flat strip bar with plane extending parallel to the door leaf 2 can, of course, also be provided, e.g., in such a way that the protuberance 18 is bent again by 90° so that it can be connected with the locking bar 12; or a round bar can be provided and connected in a suitable manner with the protuberance 18. Instead of a bar lock, a different locking system requiring a bolt lock or the like can also be actuated.

Further, it can be seen from FIG. 1 and FIG. 22 that the locking bar 12, 112 is guided above (see FIG. 1) and below (FIG. 22) the door plate 4, 104 by means of bar guides 32, 132 (see also FIG. 5 and FIG. 24) which are fastened at the inner surface in the vicinity of the fold. In this case, the receptacles 40, 140 are provided in relative proximity to these bar guides (for the purpose of relieving the bar), wherein locks, e.g., rollers 38 supported at both sides of the locking bar 12 or a pressed-out portion 138 protruding on one side (FIG. 23), which are carried by or formed by the locking bar 12, 112 can run into these receptacles 40, 140. The construction of this receptacle 40, 140 was already described in detail with reference to FIGS. 20 or 25 and 26. FIG. 1 and FIG. 22 show that a dependably functioning latching and locking can also be effected in particularly narrow cabinet-side receptacles 40, 140 as a result of the locking bar 12, 112 which is arranged at right angles with respect to the inner side of the door, so that the closure can also be used in relatively narrow vertical spaces or section frames of cabinets and housings.

Figure 5:
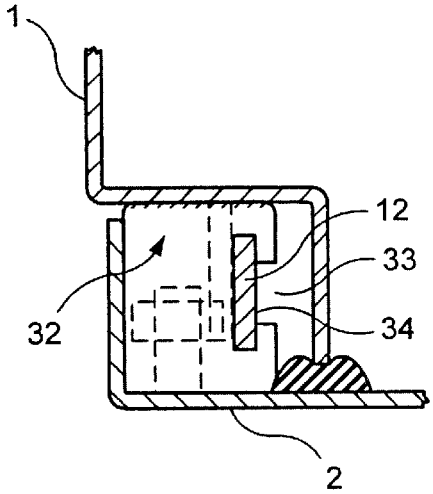
FIG. 5 shows a cross-sectional view along line V—V in FIG. 1.
Figure 24:
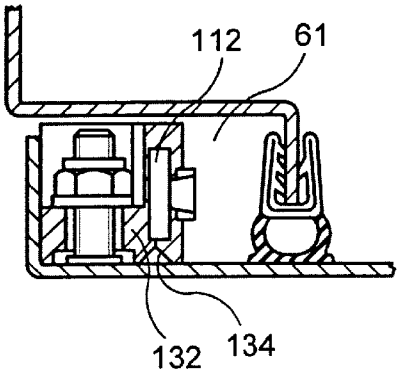
FIG. 24 shows a sectional view along line XXIV—XXIV of FIG. 21.

The arrangement of the bar guides and, where applicable, receptacles in the respective corner regions results in a particularly high level of stability, also with respect to preventing rotation of these block-shaped elements, even when the latter are fastened only by one fastening bolt as is the case, for example, in the guide element according to FIG. 5 or FIG. 24. For the same reason, as is shown in the drawing, the receptacle according to FIG. 6 can also be fastened by two screw bolts 68 or only one screw bolt 68. The arrangement in the corner of the fold space reduces the risk of rotation which would impede smooth operation.

FIG. 8 and FIG. 23 shows that the swivel lever 25, 125 has virtually the same construction as that known from the European patent. The horizontally extending base plate 5 has, at one end, a cover cap 70 which is secured by screws 72, 172 which can be screwed into two threaded bore holes 71, 171 formed by the base plate 5,105. In so doing; the door leaf 2 is clamped between the rim regions 73, 173 of the base plate 5, 105 on the one hand and the cup edges 74, 174 of the cover cap 70, 170 on the other hand, so that the entire arrangement is secured within the door leaf. The projections in the threaded bore hole region 71, 171 which serve to receive the screws 72, 172 could serve to center the base plate 5, 105 within the opening formed by the door leaf, or other protuberances and edges which can contact the circumferential edges of the opening in the door leaf can be used for this purpose.

Figure 11:
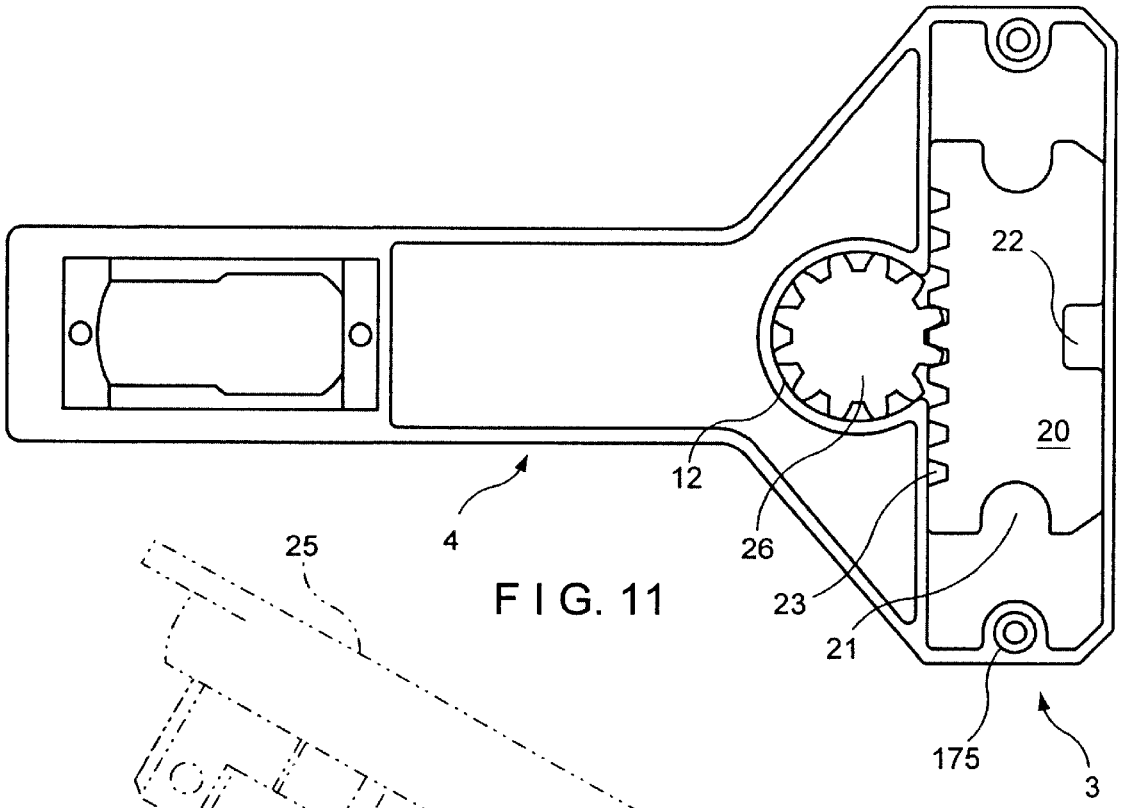
FIG. 11 shows a rear view of a similar construction of the closing device shown in FIG. 1.
Figure 12:
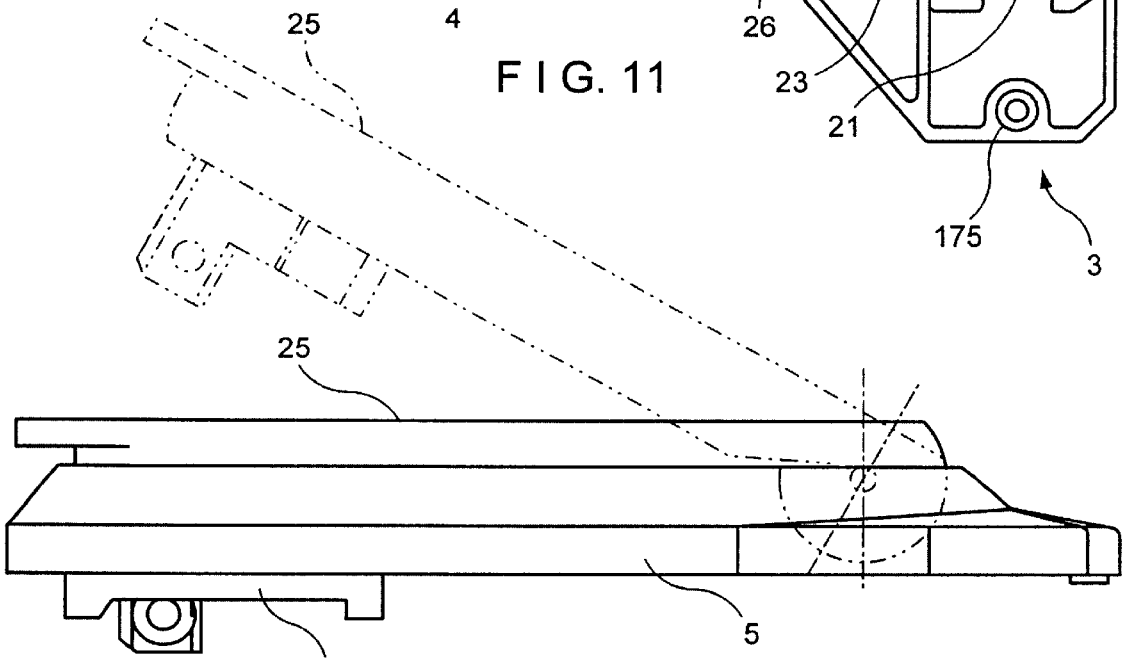
FIG. 12 shows a side view of the closing device shown in FIG. I 1.
Figure 13:
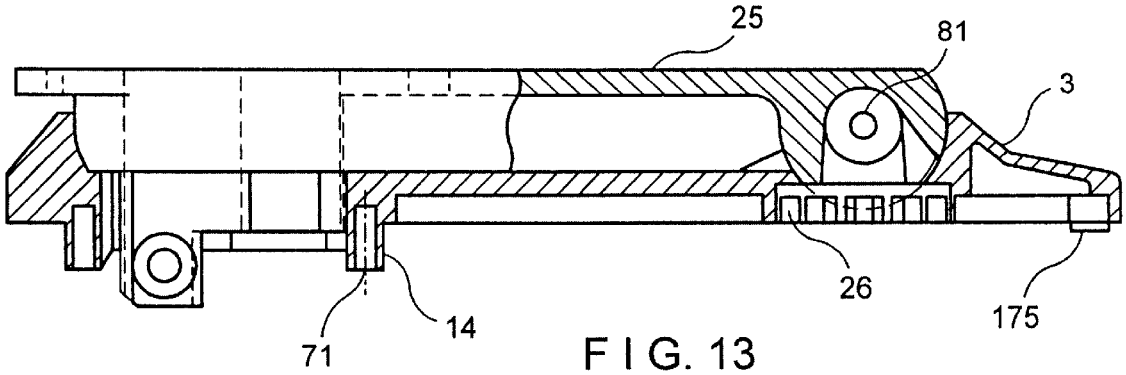
FIG. 13 shows an axial sectional view through the closing device shown in FIG. 11.
Figure 15:
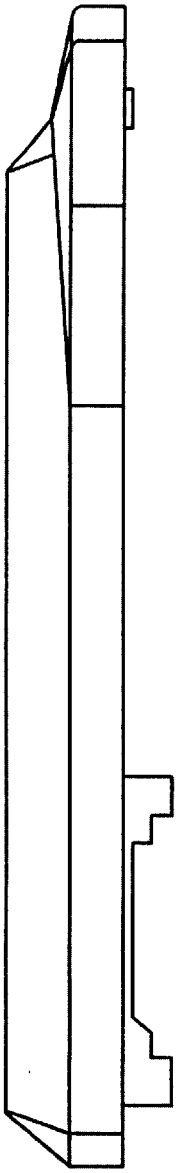
FIG. 15 shows a view from the right-hand side of the closing device shown in FIG. 14.
Figure 14:
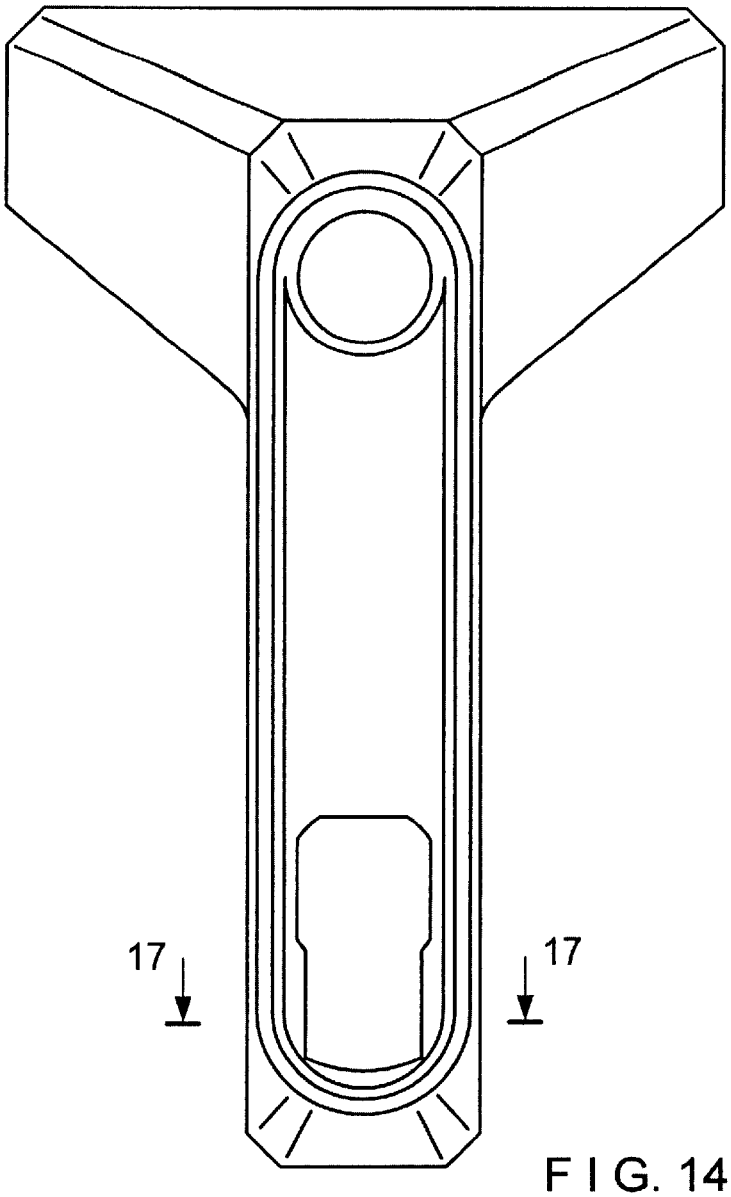
FIG. 14 shows a top view of the closing device shown in FIG. 11.
Figure 16:
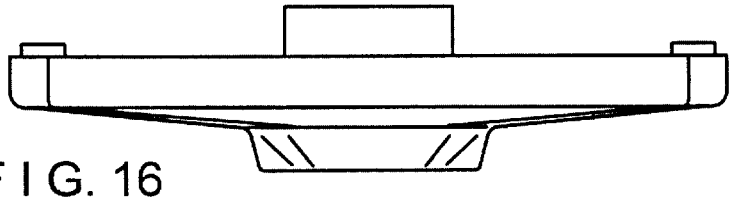
FIG. 16 shows a top view of the closing device shown in FIG. 14.
Figure 17:
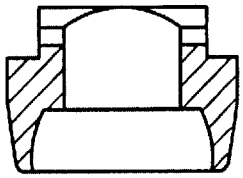
FIG. 17 shows a cross-sectional view along line XVII—XVII in FIG. 14.
Figure 19:
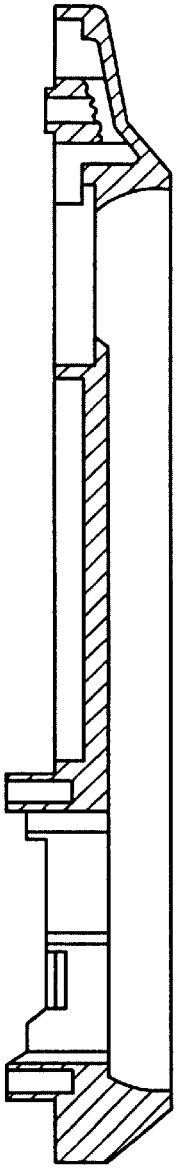
FIG. 19 shows an axial sectional view along section line IXX—IXX in FIG. 18.
Figure 18:
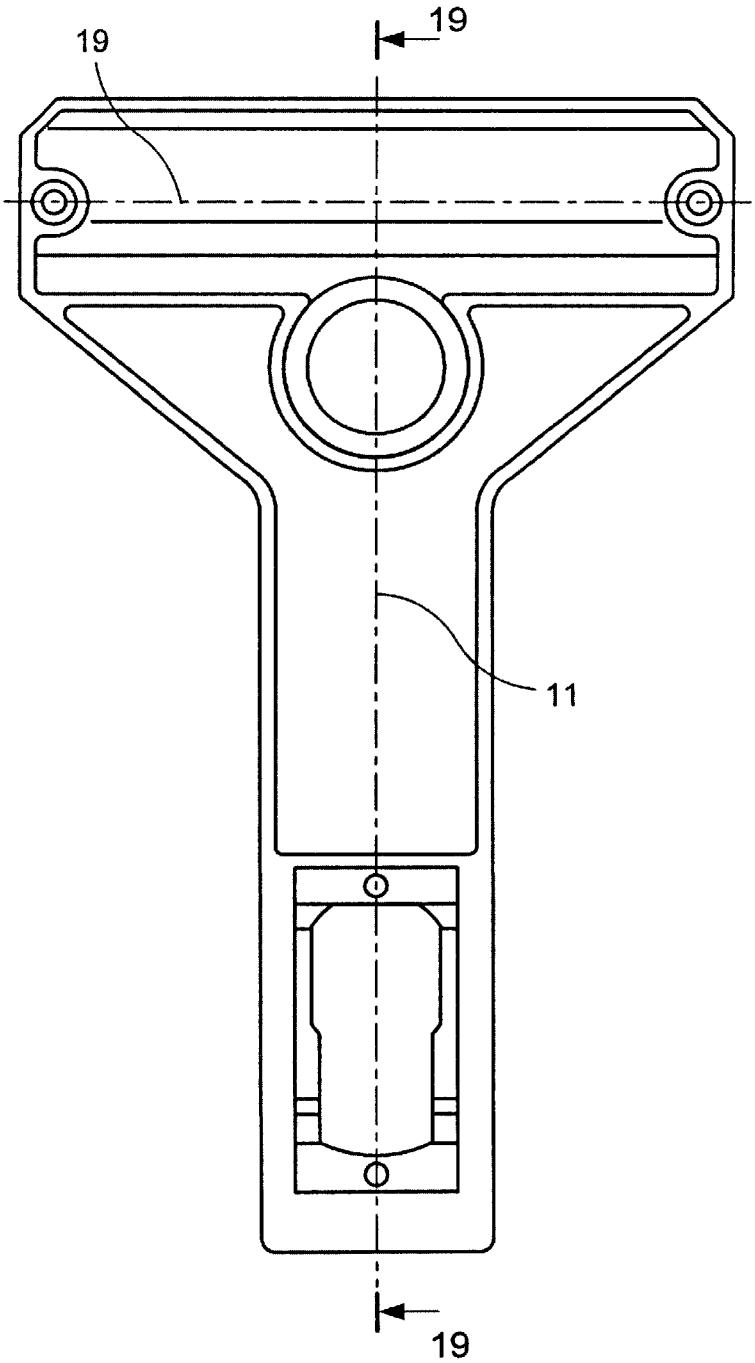
FIG. 18 shows a rear view of the closing device shown in FIG. 14.

FIG. 11 shows another type of fastening in which screws can be inserted into threaded bore holes 175 formed by the door plate 4, these screws being guided through corresponding bore holes or notches in the door leaf. The screws contact the inner surface of the door leaf 2 with their head (possibly with the intermediary of a washer) and are guided in a corresponding threaded bore hole 175 of region 3, so that this region 3 is better secured at the door leaf 2. The push plate 20 which extends in this region can have corresponding necked-down portions 21 so that its movement is not impeded by these screws or threaded bore hole regions. Similar fastenings are included in the embodiment forms according to FIGS. 27, 28 and FIGS. 29, 30.

The closing device 10, 110 is opened and closed in that the swivel lever 25, 125 is swiveled out and the spindle pinion 26 which is arranged in the region of the swivel axis 53 and serves as a nut for the lock is correspondingly displaced.

This rotational adjusting movement is transformed into a vertical movement of the push plate, e.g., by teeth 23 of the push plate 20, 120 which mesh with the teeth of the pinion 26, and is transmitted via the driver 16 and protuberance 18 to the locking bar 12 and to the closure elements 38, 138, of which there is at least one, arranged on the locking bar 12, 112.

The push plate 20 is received in a spatially locking engagement in an intermediate space formed by the door plate region 3 and the door 2 as shown in FIGS. 4 and 11 in a side view and top view. The connection between the push plate 20 and the locking bar 12 is effected via a protuberance 18 which is formed at the driver 16 or (according to FIG. 22) is integral with the bar 112 and is slid into a laterally arranged recess or opening 22 of the push plate. The circumference and number of teeth of the pinion and the number of teeth 23 of the push plate 20 are so designed that a rotation of the pinion 26 by 90° causes a displacement, e.g., by three tooth intervals (distance X according to FIG. 7 or FIG. 20 and, respectively, FIG. 22A and FIG. 22B).

Figure 25B:
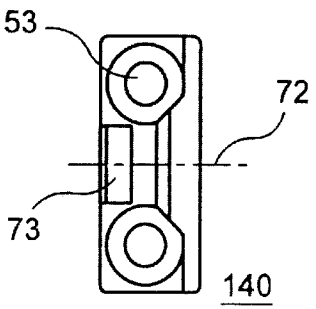
FIGS. 25A, 25B and 25C show different views of the cabinet-side receptacle used in FIG. 21.
Figure 25A:
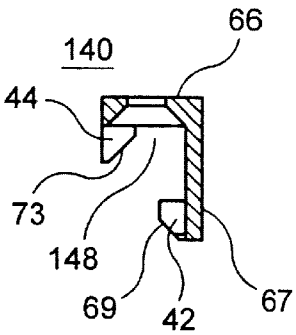
Figure 25C:
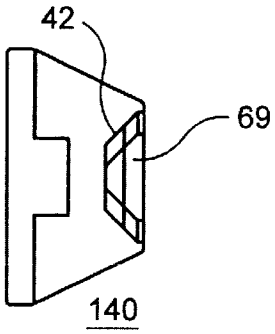
Figure 26:
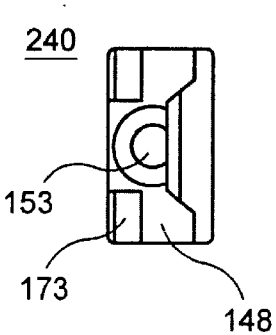
FIG. 26 shows a view of an alternative cabinet-side receptacle.

With respect to a receptacle 40 according to FIG. 20, this movement causes the roller pin 38 to move out of the (center) open position, as is shown in FIG. 20, into one of the two possible closing positions, e.g., into the upwardly guided closing position, as a result of displacement by distance X. Conversely, closing can also be effected in that the roller pin 38 is displaced downward by this distance X. With respect to a closure element according to FIG. 22, the middle position is a closing position in which the stamped out portion 138 is held by a hook 69 (FIG. 25A). The latter is freed as the result of displacing by a distance X, see FIGS. 22A and 22B.

It may sometimes be advisable to change the closing position by changing the swivel lever position which was formerly that of the open door into a swivel lever position for a closed door, and vice versa. In this case, it is possible to remove the protuberance 18 of the driver 16 from one of the recesses 22 and to insert it into a second recess which is at a distance of length X from the first recess.

Figure 7:
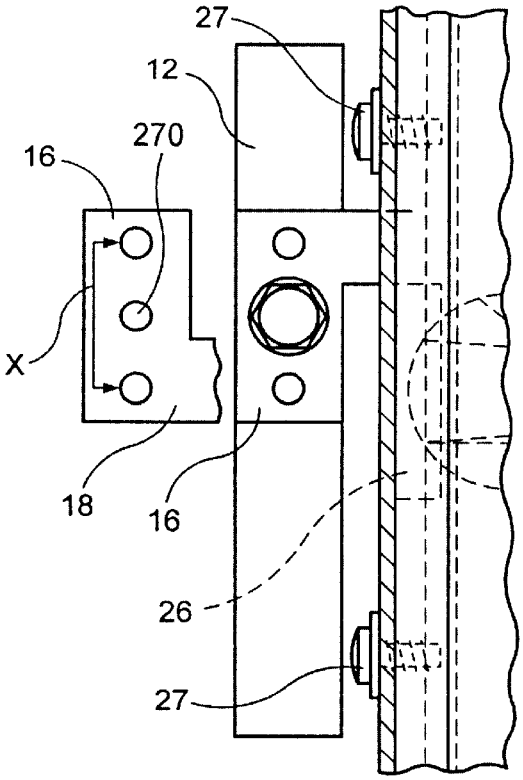
FIG. 7 shows a side view, partially cut away, of a portion of the swivel lever closing device shown in FIG. 1.

Further, it is possible to convert the driver 16 on the locking bar 12 in such a way that the position of the locking bar 12 does not change, as will be seen from FIG. 7. For this purpose, it is necessary only to loosen the screw 69 and then lift the driver 16 and rotate it by 180 ° such that the protuberance 18 moves from the upper position shown in the drawing into the lower position, whereupon the driver 16 is again screwed on the locking bar 12 by means of screw 69.

The cross-sectional view according to FIG. 4 shows the cooperation of the swivel lever 25 and the spindle pinion 26, at which the swivel lever 25 is articulated via an articulated pin 81, with the push plate 20, the spindle pinion being supported so as to be rotatable and locked axially in an annular space 82 formed in the base plate 5. By means of the corresponding edge of the annular space 82, the base plate 5 accordingly prevents the pinion from being pulled downward by the swivel lever 25. Conversely, the pinion is also pressed against the edge 82 by the swivel lever resulting in a stable rotational support. The row of teeth 23 of the plate 20 then meshes with the teeth of this pinion, so that the plate 20 slides between the plane of the door leaf 2 and the inner surface 83 of the door plate region 3 and is supported with slight play.

FIG. 1, in combination with FIGS. 4, 5, 6, 7 and 8, shows that the driver 16 and protuberance 18 (with associated slot), respectively, lie outside the sealing region of the cabinet. Therefore, the slot in the fold region of the door leaf does not compromise the tightness of the seal. The slot can also serve as a stop for the movement of the driver 16 or protuberance 18 in that it has only a determined longitudinal extension. Accordingly, the open position, for instance, is unambiguously defined for the user: for example, the user need not hunt or search for the run-in region for the rollers 38 which is formed by the receptacle 40. Rather, when reaching the stop, the rollers are situated exactly over the run-in or opening 65. In order to be able to change this position, a plurality of axially offset openings 70 can be provided in the bar 12 and/or in the driver 16 in the same way that switching is made possible by converting the driver in the manner already mentioned.

Figure 27:
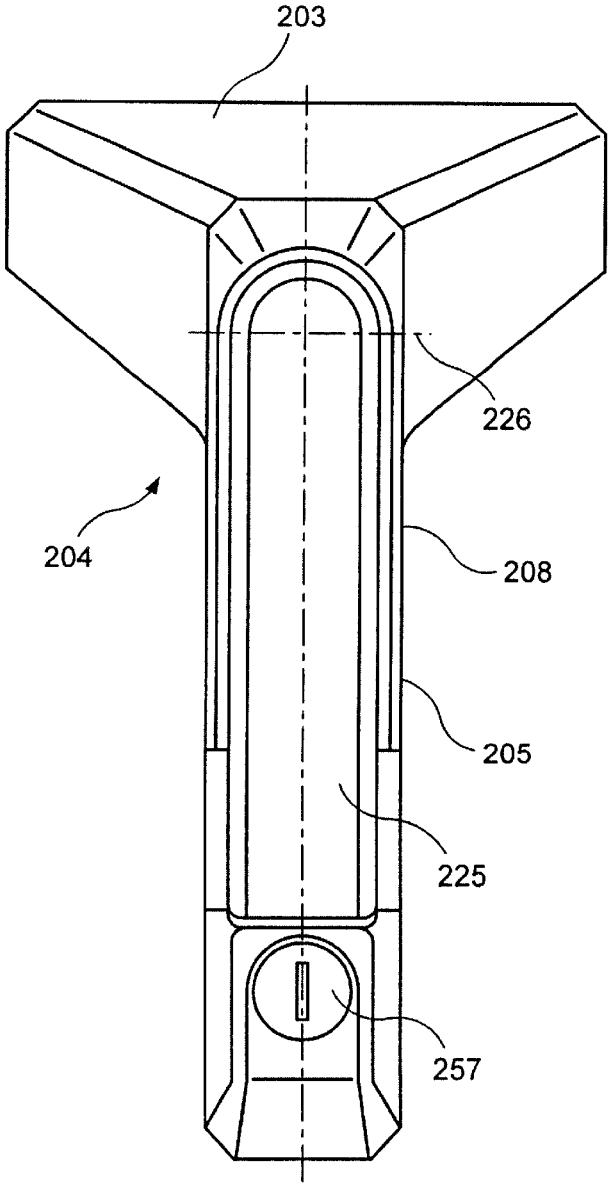
FIG. 27 shows a top view of a swivel lever closure according to the invention in which the lock of the swivel lever is accommodated in the door plate.

In the embodiment form shown in FIG. 27, the door plate does not penetrate the door leaf 202 at any point. It is secured by screws 227, see FIG. 28, that are inserted through corresponding round openings in the door leaf 202 and screwed into corresponding threaded bore holes in the door plate. FIG. 27 also shows a further distinction in that, in this case, it is not the end of the swivel lever 225, but rather its base plate 205 or door plate region 208 that has a cylinder lock (see cylinder lock 257).

Figure 28:
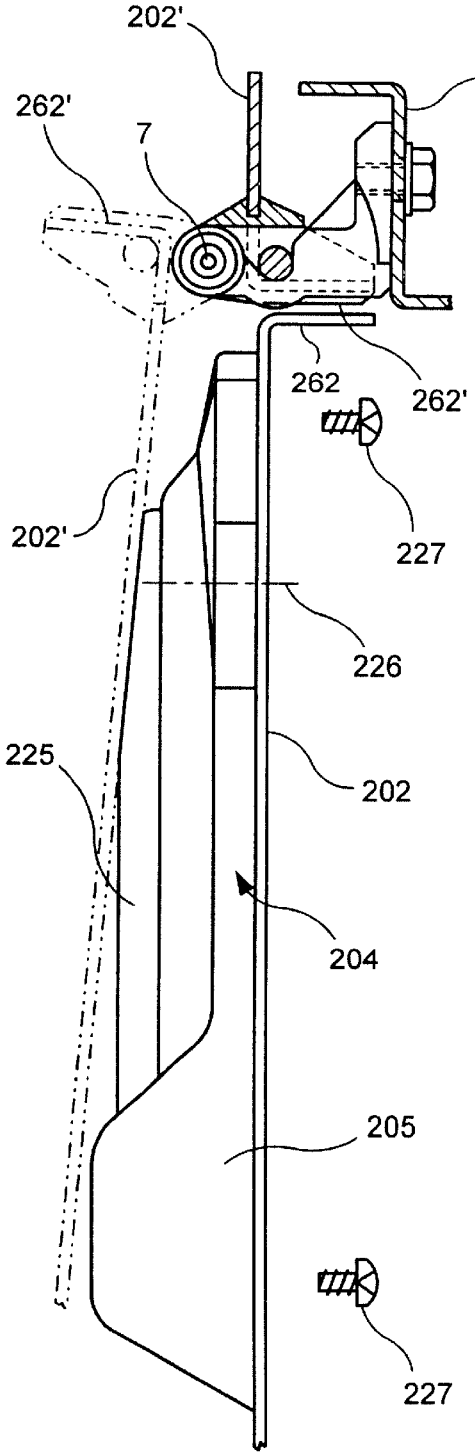
FIG. 28 shows a side view of the closure in FIG. 27 used in a row of cabinets.

The construction according to the invention shown in FIGS. 27 and 28 shows in a particularly clear manner the advantages resulting when the closure is used in row cabinet installations. Accordingly, FIG. 27 shows the door leaf 202 of a first row cabinet and the door leaf 202' of another cabinet arranged directly adjacent to it. The folds 262 of door leaf 202 and the fold 262' of door leaf 202' are a few millimeters apart. The door leaf 202' is articulated at a cabinet frame 201' so as to be swivelable about a pin 7 and enables an opening angle of 180° for the door leaf 202' even when used in row cabinets when a cabinet is installed closely adjacent to the next cabinet. In order to achieve the full opening angle of 180°, however, it was necessary to change the fastening side of consecutive cabinets. Accordingly, the hinges 7 lay next to one another. However, if the fastening side of two successive cabinets, in this case 202 and 202', is identical (namely, on the left-hand side) as is shown in FIG. 28, a door leaf hinge 7 no longer lies directly next to another door leaf hinge 7 of the next cabinet, but lies rather in the region of a door plate 204 projecting over the door leaf, as can be seen in this case. Depending on the height of this door plate, the door plate accordingly hinders the door leaf 262' from opening fully 180° as can be seen. The closer the door plate 204 is to the fold 262 of the door leaf 202 and the higher it projects over the outer surface of the door leaf, the greater this hindrance becomes. The closing device, according to the invention, makes it possible to improve these conditions in a twofold manner: In the first place, the actuating axis of the closure, designated by 226 in FIG. 28, is backed off from the door edge 262, so that the extent to which the door leaf 202' can be swiveled is only slightly restricted, even in the case of vertically projecting actuating devices. In the second place, it is achieved that locks for a swivel lever which project up especially far no longer lie close to the door fold 262, as was the case in the prior art, but rather are far away from this edge, namely, because of the horizontal arrangement of the actuating lever 252, so that the free end of the latter, e.g., with a locking device 257, moves in the direction of the center of the door away from the edge 262.

These steps also make it possible, for example, according to the embodiment form in FIGS. 27 and 28, to completely dispense with a larger opening in the door leaf and to accommodate the locking device 257 entirely on the front face of the door leaf, so that, although the constructional height increases as can clearly be seen from the bottom part of FIG. 28, this elevated construction lies far from the fold 272 of the door leaf 202 because of the horizontal arrangement and is no longer troublesome.

Figure 30:
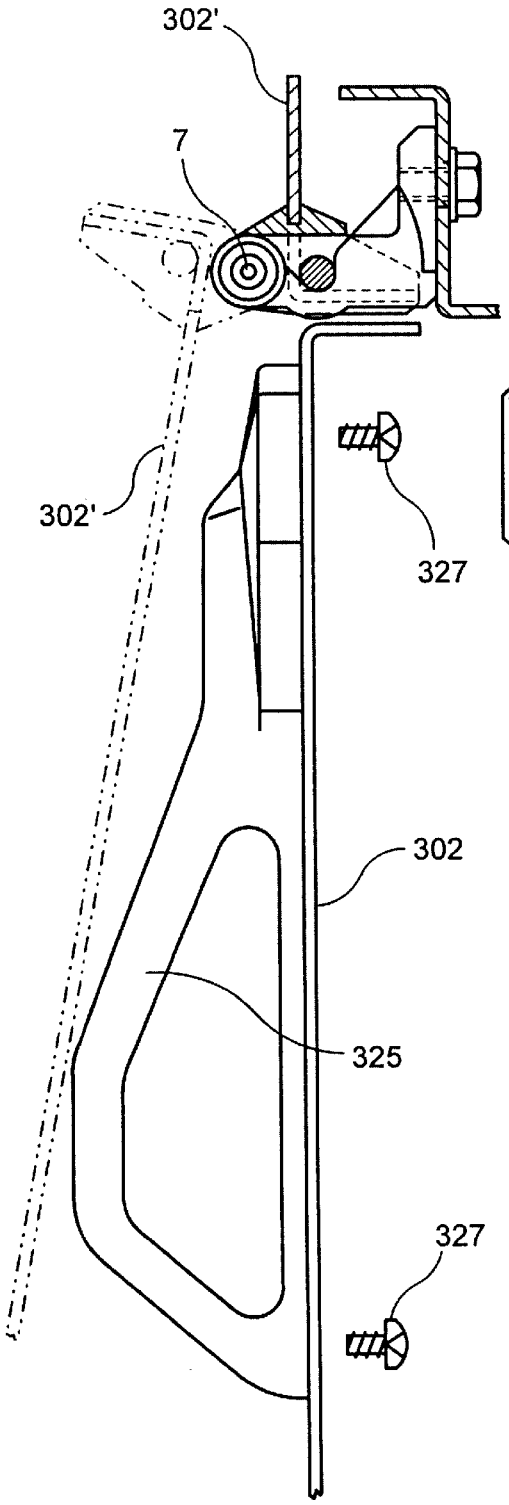
FIG. 30 shows a side view of the closure in FIG. 29 used in a row of cabinets.
Figure 29:
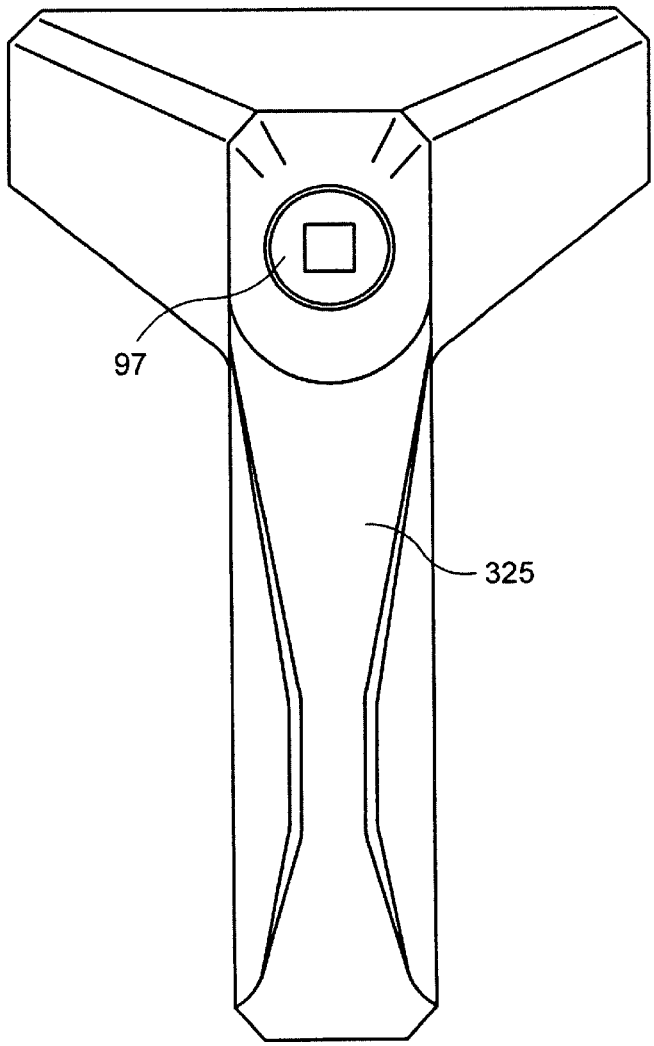
FIG. 29 shows a top view of a key lock according to the invention.

Similar considerations apply to the embodiment form according to FIGS. 29 and 30, in which a fixed handle 325 which may also be screwed to the door leaf 302 by screw bolts 327 is provided instead of a handle that swivels out. The spindle pinion which is also present in this embodiment form is provided in this case with an insert wrench socket 97, which is four-cornered in the present case, wherein a corresponding actuating wrench, such as a square socket wrench, can be inserted into this socket and the spindle pinion can then be turned. As can be seen from a comparison with the embodiment form of FIGS. 27 and 28, the maximum possible opening angle for the door leaf 302' of the adjacent cabinet is only slightly larger in this case, namely, because of the larger constructional height of the handle 325.

The closing device according to the invention is applicable, for example, in switch cabinet construction.

While the foregoing description and drawings represent the present invention, it will be obvious to those skinned in the art that various changes may be made therein without departing from the true spirit and scope of the present invention.

What is claimed is:

1. A closing device for doors of housings or cabinets, preferably made from thin wall material such as sheet steel, especially for the actuation of locking systems, such as locking bars, which can be introduced in the fold space in sheet-metal cabinet doors, said closing device comprising:

a door plate with a first and second door plate region;

said first door plate region being elongated and having a handle, such as a swivel lever, and supporting a spindle pinion so as to be rotatable;

said second door plate region supporting a push plate so as to be displaceable, which push plate is in an operative connection with the spindle pinion and which is, in turn, in an operative connection with the locking system via a shoulder which extends through a slot in the door that is concealed by the second door plate region;

said second door plate region being similarly elongated and being shaped and connected in one piece with the first elongated door plate region in such a way that an axis of extension of the second elongated door plate region extends at right angles to an axis of extension of the first elongated door plate region.

2. The closing device according to claim 1, wherein a receptacle for actuation is provided at the free end of the spindle of the spindle pinion.

3. The closing device of claim 2, wherein the receptacle for actuation is a socket wrench.

4. The closing device according to claim 1, wherein a handle in the form of a swivel lever which can be swiveled into the first door plate region is articulated at the free end of the spindle of the spindle pinion.

5. The closing device according to claim 4, wherein a locking device, such as a cylinder lock, is provided in the region of the free end of the swivel lever, wherein said locking device holds the swivel lever in the swiveled-in position in such a way that it can also be unlocked, said locking device being arranged either in the swivel lever or in the first door plate region.

6. The closing device according to claim 4, wherein the door plate is provided with protuberances for engaging in at least one cutout on the door side, wherein a protuberance is formed at the end of the first elongated door plate region remote of the second door plate region and cooperates with the locking device, such as a cylinder lock device, for the swivel lever.

7. The closing device according to claim 6, wherein the protuberance of the first door plate region can be fixed as a holding block in the cutout of the door, while the second door plate region has threaded bore holes in its surface facing the door, wherein fastening screws can be inserted through these threaded bore holes.

8. The closing device according to claim 1, wherein a locking bar is provided which is in an operative connection, via the shoulder, with the push plate which is supported by the second elongated door plate region so as to be displaceable parallel to the axis of the locking bar.

9. The closing device according to claim 8, wherein cabinet-side receptacles for locking elements of the locking bar are constructed in the region of the locking bar.

10. The closing device according to claim 1, wherein the spindle pinion has teeth which mesh with teeth of the push plate, and wherein the push plate is in an operative connection with the locking bar or some other closing device via the shoulder which is constructed as a driver or protuberance, and wherein the spindle pinion and the push plate are received by the first and second door plate region, respectively, virtually in a positive engagement.

11. The closing device according to claim 10, wherein the driver is adjustable at the inner side of the door and in the area of the second door plate region and is connected with the locking bar via connection areas, and wherein the driver is guided by a protuberance in a recess of the push plate which extends at right angles to the driver plane.

12. The closing device according to claim 8, wherein projections or rollers forming locks with the locking bar are provided in the area of the cabinet-side receptacle(s) on one or both sides of the locking bar, and wherein receptacles which are constructed in a complementary manner and have vertical stop faces and in which the projections or rollers of the locking bar engage in the closing position thereof are provided, wherein the receptacles which are preferably fastened in the fold area of a cabinet frame or housing frame are constructed as hooks or double-hooks with an opening for the locking bar, which opening is directed toward the door leaf.

13. The closing device according to claim 1, wherein the second door plate region which supports the push plate is fastened to the door with fastening elements such as screws, and wherein recesses are formed in the push plate in the region of the fastening elements.

14. The closing device according to claim 1, wherein the push plate has a first opening oriented to its center axis for receiving the protuberance and two additional recesses at a distance X along the longitudinal axis relative to said recess, wherein said distance X is that distance traveled by the push plate when the spindle pinion is rotated by 90°.

15. The closing device according to claim 14, wherein the protuberance is formed by a molded piece which is formed from a protuberance area and a driver area, wherein the protuberance area is arranged at one end of the driver area and the driver area has a longitudinal extension corresponding approximately to the length of the protuberance width plus said distance X.

16. The closing device according to claim 15, wherein the driver area has, in the longitudinal axis oriented to the axis of the locking bar, three bore holes through which are guided fastening screws which can be received in a threaded bore hole formed by the locking bar, wherein the axial distance between the bore holes makes up a fraction of the distance X, equals the distance X, or is a multiple of the distance X.

* * * * *